US007310859B2

(12) United States Patent
Fleissner

(10) Patent No.: US 7,310,859 B2
(45) Date of Patent: Dec. 25, 2007

(54) WATER-PERMEABLE DRUM FOR THE HYDRODYNAMIC NEEDLING TEXTILE WEBS AND METHOD OF MAKING THE DRUM

(75) Inventor: Gerold Fleissner, Zug (CH)

(73) Assignee: Fleissner GmbH, Egelsbach (DE)

( * ) Notice: Subject to any disclaimer, the term of this patent is extended or adjusted under 35 U.S.C. 154(b) by 48 days.

(21) Appl. No.: 10/555,973

(22) PCT Filed: May 13, 2004

(86) PCT No.: PCT/EP2004/050788

§ 371 (c)(1),
(2), (4) Date: Nov. 8, 2005

(87) PCT Pub. No.: WO2004/101873

PCT Pub. Date: Nov. 25, 2004

(65) Prior Publication Data

US 2006/0283213 A1 Dec. 21, 2006

(30) Foreign Application Priority Data

May 15, 2003 (DE) ..... 103 22 052

(51) Int. Cl.
*D04H 1/46* (2006.01)
*D06B 23/02* (2006.01)

(52) U.S. Cl. ..... 28/104; 28/167

(58) Field of Classification Search ..... 28/104, 28/105, 167, 142; 162/115, 348, 357, 902, 162/903, 351, 368, 372, 373; 442/97, 98, 442/101, 103, 60, 19, 149–151, 229; 492/30–34, 492/37, 49, 50, 51, 52, 28, 53–55
See application file for complete search history.

(56) References Cited

U.S. PATENT DOCUMENTS

| | | | | |
|---|---|---|---|---|
| 3,750,237 | A * | 8/1973 | Kalwaites | 28/105 |
| 3,787,932 | A * | 1/1974 | Kalwaites | 28/105 |
| 3,957,087 | A * | 5/1976 | Johnston | 492/32 |
| 4,297,404 | A * | 10/1981 | Nguyen | 428/85 |
| 4,868,958 | A * | 9/1989 | Suzuki et al. | 28/104 |
| 5,609,046 | A * | 3/1997 | Fleissner | 68/5 D |
| 5,759,929 | A * | 6/1998 | Ikezawa et al. | 442/385 |
| 6,024,553 | A * | 2/2000 | Shimalla | 425/290 |
| 6,055,710 | A * | 5/2000 | Fleissner | 28/104 |
| 6,324,738 | B1 * | 12/2001 | Fleissner | 28/104 |
| 6,708,381 | B2 * | 3/2004 | Strandqvist et al. | 28/104 |
| 6,790,796 | B2 * | 9/2004 | Smith et al. | 442/189 |
| 2002/0100153 | A1 * | 8/2002 | Takai et al. | 28/104 |
| 2006/0070217 | A1 * | 4/2006 | Sayers | 28/104 |

* cited by examiner

*Primary Examiner*—A. Vanatta
(74) *Attorney, Agent, or Firm*—Andrew Wilford

(57) ABSTRACT

A water-permeable drum assembly for the hydrodynamic needling of textile materials in order to reinforce and structure the textile materials or refine the surface thereof has an intrinsically stable sieve drum provided with apertures and an outer tubular sieve-type cloth made of intersecting wires and pulled across and fixed to an outer surface of the drum. The outer sieve-type cloth has a coating that stabilizes intersections of the wires.

14 Claims, 5 Drawing Sheets

Fig. 8
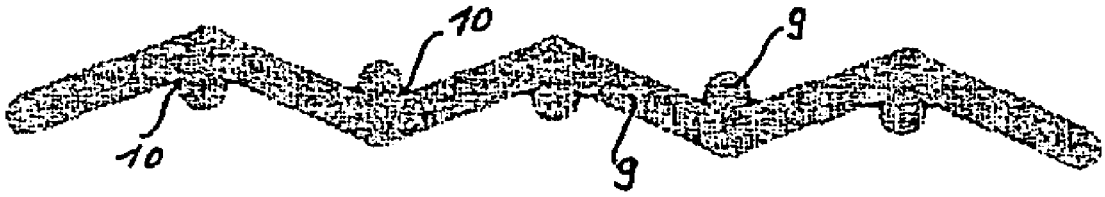
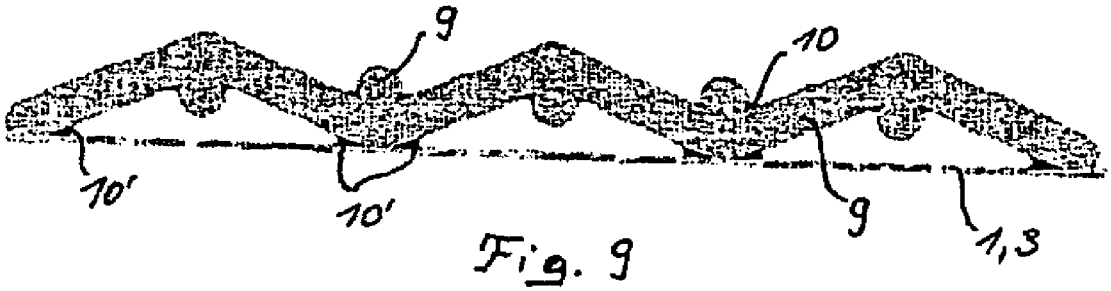
Fig. 9

WATER-PERMEABLE DRUM FOR THE HYDRODYNAMIC NEEDLING TEXTILE WEBS AND METHOD OF MAKING THE DRUM

CROSS REFERENCE TO RELATED APPLICATIONS

This application is the U.S. national phase of PCT application PCT/EP2004/050788, filed 13 May 2004, published 25 Nov. 2004 as WO 2004/101873, and claiming the priority of German patent application 10322052.6 itself filed 15 May 2003, whose entire disclosures are herewith incorporated by reference.

FIELD OF THE INVENTION

The invention relates to a water-permeable drum assembly for the hydrodynamic needling of textile materials such as nonwovens, tissue, cloth, knitted fabrics or similar in order to reinforce and structure said textile materials and/or refine the surface thereof, consisting of an intrinsically stable drum provided with apertures and a tubular sieve-type cloth or knitted fabric which is made of wires.

Such drums are known in the field of flow-through drying from GBM 1 886 883. The design is advantageous because the textile material to be treated does not lie on the perforated drum which would result in nonuniform flow through the material web and marking of the drum perforation on the textile material. If, on the other hand, a coarse sieve-type woven fabric is preferably located first on the drum and then a finer fabric on which the textile material then comes to rest, the treatment medium can treat the textile material uniformly over the surface. For hydrodynamic needling it has also been considered that the coarse sieve-type cloth, that is the under-covering, is replaced by strips arranged closely adjacent to one another, for which purpose reference is made to U.S. Pat. No. 6,055,710.

Practice has shown that creases form over the surface of the sieve-type cloth or knitted fabric. Creases form in the sieve-type cloth even when the sieve-type cloth consists of a diagonally woven or used tubular cloth which decreases in diameter under an axial tension produced during assembly and thus comes to rest during assembly firmly and over the entire area on the supporting sieve drum or on the under-coating. Creases which are formed in practice, that is when the needling drum is used as the textile-material transporting drum, are especially disadvantageous. Nonuniform distortions which need to be avoided in any case are then formed in the textile material as a result of the distortions in the sieve-type cloth.

OBJECT OF THE INVENTION

It is the object of the invention to develop a drum assembly with sieve-type cloth or knitted fabric looped around said drum wherein this formation of creases is made impossible.

SUMMARY OF THE INVENTION

Starting from the drum assembly of the type specified initially, the invention consists in the fact that the sieve-type cloth or knitted fabric has a coating that stabilizes the intersections of the wires. The sieve-type over-covering consists of metal wires which are interwoven or knitted together. Of necessity there is always the possibility of movement of the metal wires at the intersections of this over-covering. This is prevented by the coating. Thus, no more creases can form over the surface of the drum.

It is especially advantageous if, as is known, the sieve-type cloth or knitted fabric is manufactured as a hose with a diagonal wire structure, it is then pulled over the sieve drum and brought to rest under longitudinal tension so that it abuts against the jacket of the sieve drum over the entire area, or better, on a previously applied under-covering such as coarser sieve-type cloth. The over-covering should be joined to the two faces of the drum, which is usually effected by soldering. The over-covering should then be coated, and specifically with a coating that stabilizes the sieve-type cloth or knitted fabric at the intersections of the wires.

In a simpler production process it is also possible to carry out the coating before assembling the over-covering. The only important thing with the desired drum is that the over-covering abuts against the sieve drum as firmly as possible over its entire area and the mobility of the wires is additionally eliminated. This is produced by the proposed coating which can be provided by plastic or by a galvanically produced metal coating, for example, by nickel plating.

BRIEF DESCRIPTION OF THE DRAWING

A drum of the type according to the invention and the possible production process of the finally coated drum with over-covering is shown as an example in the drawings. In the figures:

FIG. 8 further shows an enlarged view of a cross-section through the coated sieve-type cloth or knitted fabric and FIG. 9 shows the coated sieve-type cloth in a view similar to FIG. 8 but said cloth was coated after mounting on the sieve drum so that as a result of the coating, a connection of the sieve-type cloth with the circumferential surface of the sieve drum also exists.

SPECIFIC DESCRIPTION

Figure 1:
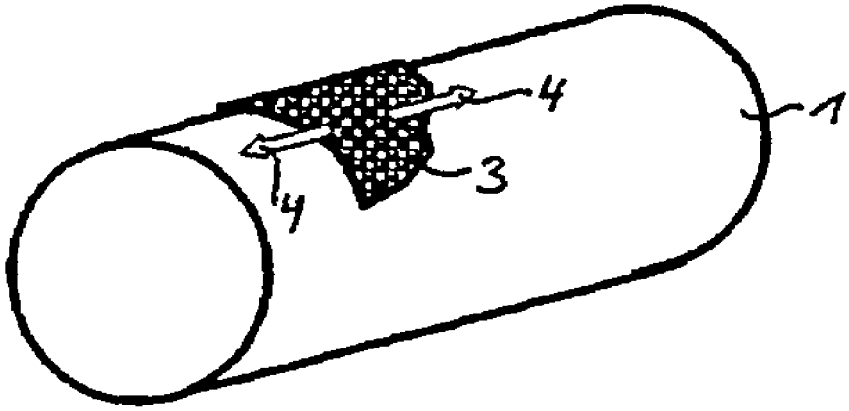
FIG. 1 is a perspective view of a perforated sieve drum with a sieve-type cloth pulled on under tension, which according to FIG. 2 is completely dipped in a bath to produce a galvanically produced over-covering both over the ready-assembled sieve-type cloth and also over the drum, the same is disclosed by FIG. 3 in the case of a perforated drum with a coarse sieve-type cloth applied previously to the drum as an under-covering for the additionally finer sieve-type cloth. This assembled drum, according to FIG. 4 is dipped in the bath for galvanic coating with nickel.
Figure 2:
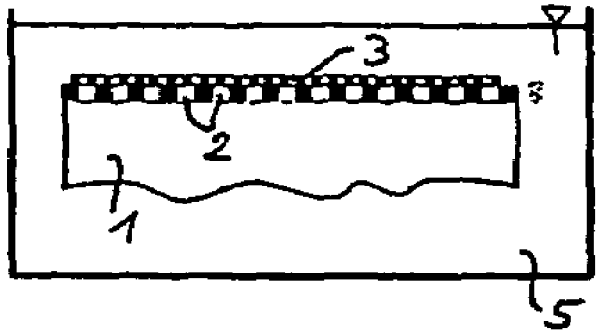

In the above-cited U.S. Pat. No. 6,055,710 in FIG. 1 a device is described where the textile material to acted upon by the water jets is guided between the endless sieves moving conically towards one another and thus the water jets initially pass through a sieve to bring about the needling. Normally the textile material lies directly on the drum as is shown in FIG. 2 in this patent and the nozzle beam or beams with the emerging water jets are directly associated with the textile material. The water-permeable drum according to the design according to the invention is applicable to both applications.

The outer surface of the perforated sieve drum 1 (the perforations 2 are shown in FIG. 2) serves as the element which bears the textile material and transports it downstream. The perforations in the outer surface are used for radially directed removal of the water of the impinging water jets, for which purpose the interior of the drum is under subatmospheric pressure. In order that this takes place uniformly over the surface of the textile material, a sieve-type cloth 3 is pulled over the drum 1, and as shown in FIGS. 1 and 2, the cloth can have a finer structure and be soldered to the ends of the drum 1 under tension as indicated by arrows 4. The sieve-type cloth or knitted fabric 3 usually consists of a hose having a diagonal structure so that the hose is reduced in diameter under the longitudinal tension produced during assembly and thus comes to rest on the drum 1 with its entire area.

Since the wire structure of the sieve-type cloth or knitted fabric 3 also remains movable when the hose is under tension, the drum assembly 1, 3 according to FIG. 2 is dipped in a bath 5 and is galvanically coated with nickel. The coating can also be accomplished differently e.g., by zinc plating or using a plastic material which can be sprayed on. As a result, not only the wire structure of the sieve-type cloth 3 is fixed permanently but also the sieve cloth 3 is connected with the drum 1 over the entire area.

Figure 3:
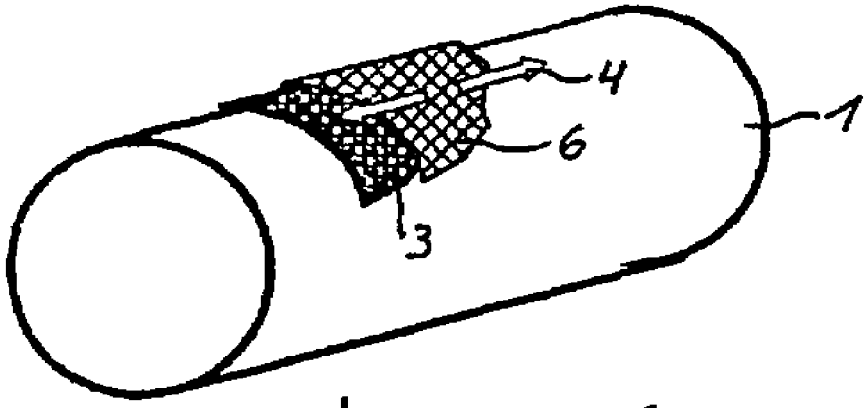
Figure 4:
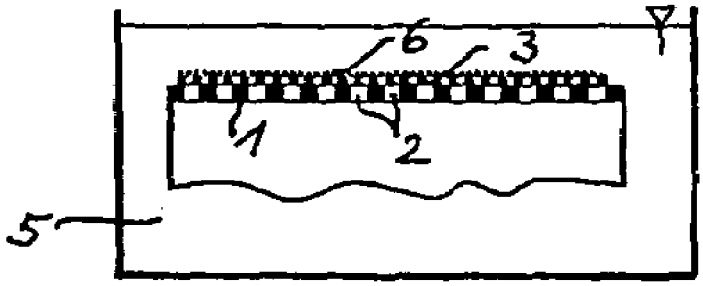

FIGS. 3 and 4 disclose the same except that a finer-structure tubular outer sieve-type cloth hose 6 is pulled over the coarser inner sieve-type cloth 3 and is also brought to rest firmly on the drum assembly 1, 3 under tension 4 and is soldered to the ends of the drum. The coating is only then carried out according to FIG. 4.

Figure 5:
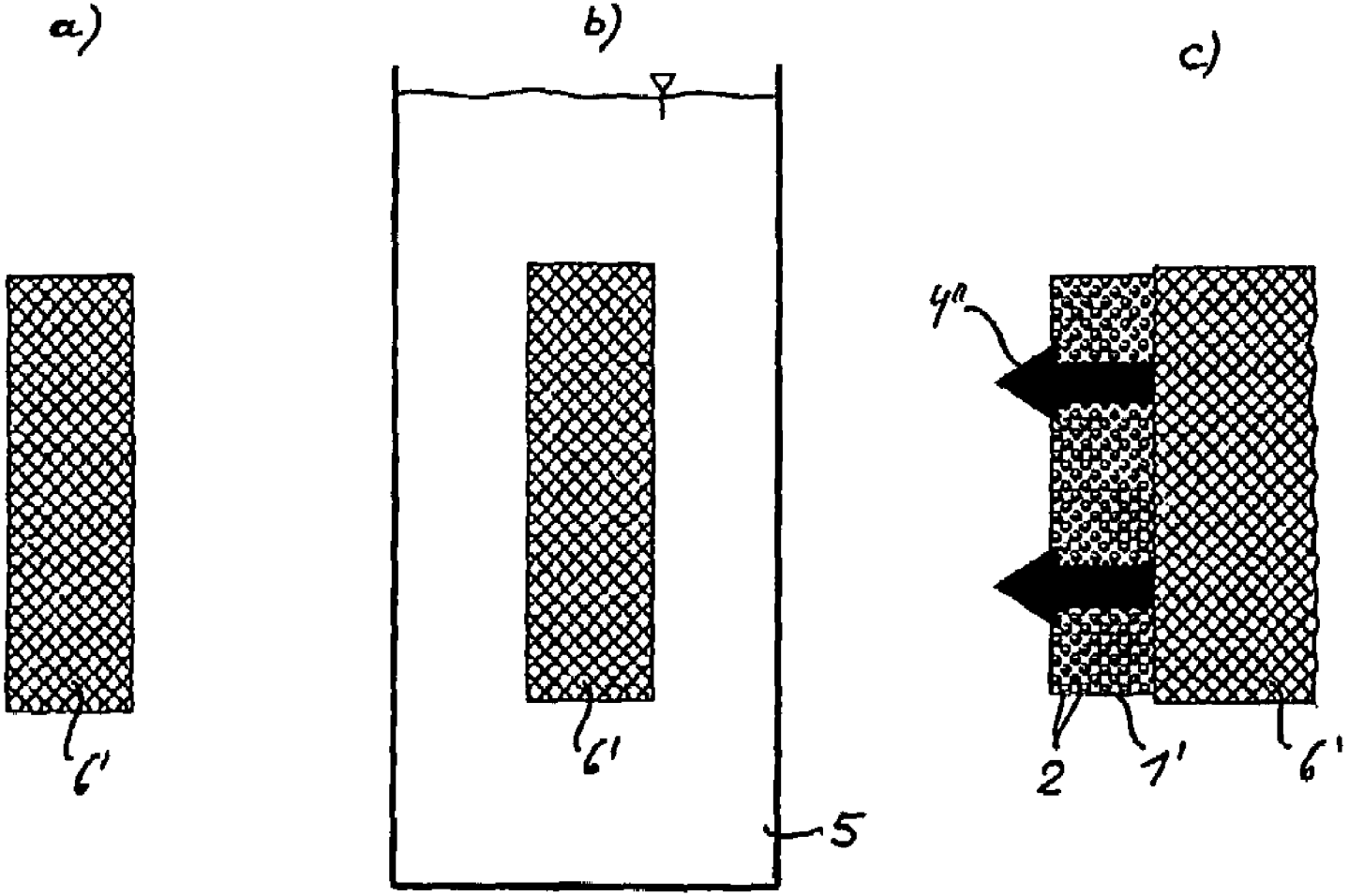
FIG. 5 shows the production process for a sieve drum with covered sieve-type cloth comprising partial steps a)-c) wherein the hose of sieve-type cloth is nickel-plated, for example, without axial tension and is then pulled over the drum and is soldered, clamped or similarly attached; then

A sieve drum with sieve-type cloth or knitted fabric looped around it, which is stabilized by a coating at the intersections of the wires, can be produced in many ways. According to FIG. 5, a hose 6' is suitably made of a desired cloth or knitted fabric in a simple fashion according to a), then dipped in a galvanizing bath 5 according to b) and coated, and is then pushed over a relevant drum 1' and soldered, clamped or otherwise attached to the face of the drum under tension as shown at 4".

Figure 6:
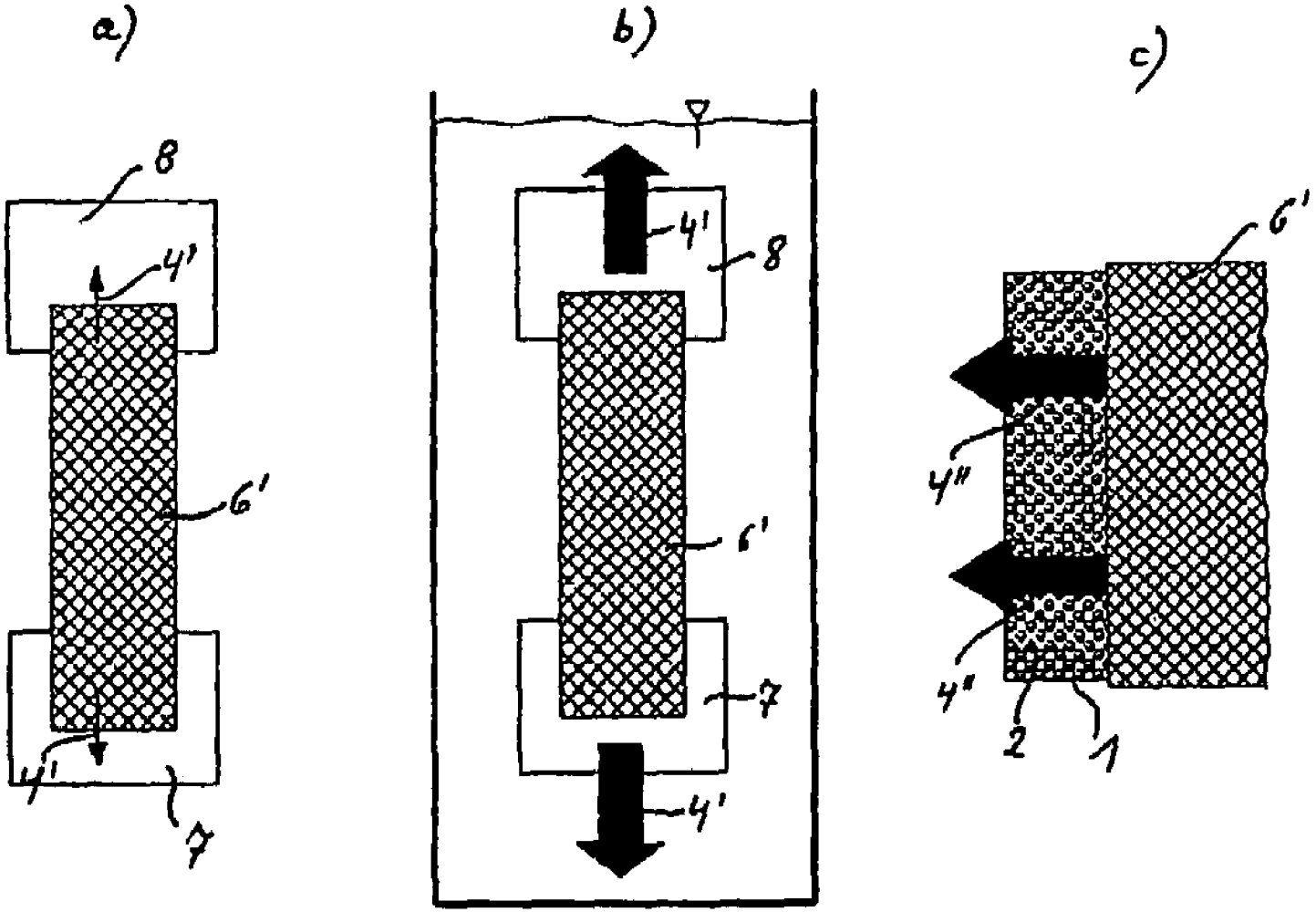
FIG. 6 shows the production process for a sieve drum with covered sieve-type cloth comprising partial steps a)-c) wherein the hose of sieve-type cloth is nickel-plated, for example, with axial tension but before assembly with the sieve drum and is then pulled over the drum and is soldered, clamped or similarly attached to the drum under axial tension, and then

It is better if, as is shown in FIG. 6, the tubular sieve-type cloth 6' is gripped at the ends by an auxiliary structure 7, 8 and is stretched to the correct dimension according to the arrow 4'. Then, as in FIG. 5*b*, the sieve-type cloth 6', again without the drum but in the tensioned state, is coated in the bath 5 and then pushed over the sieve drum 1' according to c) and soldered, clamped or otherwise attached to the faces of the drum under tension 4".

Figure 7:
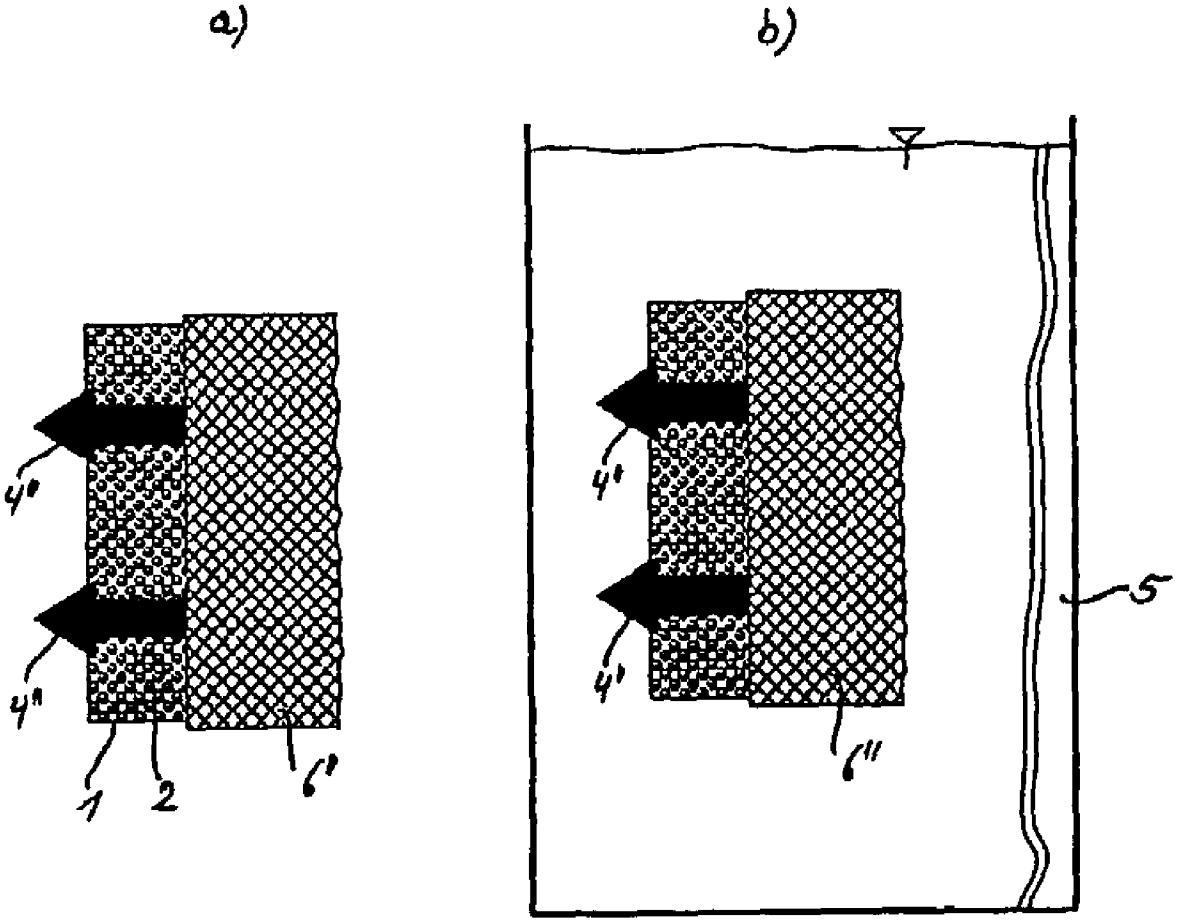
FIG. 7 shows the production process for a sieve drum with covered sieve-type cloth comprising partial steps a)-b) wherein the initially untreated hose of sieve-type cloth having a diagonal structure is pulled over the sieve drum, then set under longitudinal tension and soldered, clamped or otherwise attached to the faces of the sieve drum. Only then is the assembled drum dipped in the bath to nickel plate all the parts.

The best solution is disclosed in FIG. 7. According to FIG. 7*a*, the tubular sieve-type cloth 6" having a diagonal structure is pushed over the sieve drum 1, gripped at the ends by means of the auxiliary structure and soldered or otherwise fixed to the ends of the drum 1 under tension as indicated at 4". This corresponds to the diagram in FIG. 1 or 3. The finally assembled drum 1 with the sieve-type cloth 6" resting thereon over the entire area and soldered thereto is then inserted in the dipping bath for coating as shown in FIG. 7*b* in order to obtain the desired drum with the coated sieve-type cloth 6" positioned firmly thereon as a result of the coating as shown in FIG. 9.

The stabilizing coating of the sieve-type cloth or knitted fabric is deduced from FIGS. 8 and 9. By applying the coating agent to the wire gauze 6, 6', 6", a connection 10 of the superimposed wires 9 is achieved in any case at all intersections of the wires 9, which resembles a welding of the wires 9. The basically loose wire gauze is thus stabilized over its entire area. The diagram in FIG. 8 corresponds to the method of producing the drum according to FIGS. 5 and 6. According to FIG. 9, not only is the wire cloth stabilized but it is also connected to the underlying surface by the coating 10'. The underlying surface can be the sieve drum 1 according to FIG. 1 or the cloth 3 according to FIG. 3 which is likewise connected to the sieve drum 1 by the coating 10' after the production process according to FIG. 7.

The invention claimed is:

1. A water-permeable drum assembly for the hydrodynamic needling of textile materials in order to reinforce and structure said textile materials or refine the surface thereof, the assembly comprising:

an intrinsically stable sieve drum provided with apertures; and an outer tubular sieve-type cloth made of intersecting wires and pulled across and fixed to an outer surface of the drum, the outer sieve-type cloth having a coating that stabilizes intersections of the wires.

2. The drum assembly according to claim 1, further comprising an inner tubular sieve-type cloth made of intersecting wires, underlying the outer cloth, and increasing a spacing between the outer surface of the sieve drum and the outer sieve-type cloth, at least the outer sieve-type cloth having the coating that stabilizes the intersections of said wires of the outer cloth.

3. The drum assembly according to claim 1 wherein the outer sieve-type cloth is applied to said sieve drum under tension, is fixed to ends of said drum, abuts closely against the outer surface of said sieve drum over its entire area, and has the coating that stabilizes the intersections of said wires.

4. The drum assembly according to claim 2 wherein the inner cloth is applied to said sieve drum under tension, is fixed to ends of said drum, has a coating that stabilizes the intersections of said wires of the inner cloth and is additionally connected to the outer surface of the sieve drum by the coating.

5. The drum assembly according to claim 1 wherein the coating is made of plastic.

6. The drum assembly according to claim 1 wherein the coating consists of metal.

7. The drum assembly according to claim 6 wherein the coating is produced galvanically.

8. The drum assembly according to claim 1 wherein the coating is produced by dipping treatment.

9. The drum assembly according to claim 6 wherein the coating consists of nickel.

10. The drum assembly according to claim 6 wherein the coating consists of zinc.

11. A method for manufacturing a water-permeable drum assembly comprising a sieve-type outer cloth made of intersecting wires, looped around a drum, and fixed to ends of said drum, the method comprising the steps of:

providing the sieve-type cloth with a coating that stabilizes intersections of the wires;

then cutting the cloth transversely to produce a section;

joining the section to form a tube of the stabilized sieve-type cloth; and pulling the tube over the drum and fixing the tube to ends of the drum.

12. A method for manufacturing a water-permeable drum assembly comprising a sieve-type cloth which is made of intersecting wires, looped around a drum, and is fixed to ends of said drum, the method comprising the steps of:

making an exactly fitting hose of a labile sieve-type cloth;

longitudinally tensioning the tube;

providing the tube with a coating that stabilizes intersections of the wires; and pulling the tube over the sieve drum and connecting the tube to the ends of said drum.

13. The method defined in claim 12, further comprising the steps prior to coating the tube and pulling the tube over the drum of:

pulling a hose of a labile sieve-type cloth over the drum;

fixing the hose to ends of said drum under longitudinal tension and thereby bringing the hose into contact with an outer surface of the drum over the entire area thereof.

14. The method defined in claim 12, further comprising the step prior to coating the tube and pulling the tube over the drum of:

pulling a hose made of a labile sieve-type cloth over the drum and thereby bringing the hose into direct contact with the outer surface of the under-covering over the entire area, the stabilizing coating then being applied to the tube and to the hose.

* * * * *